US010464701B2

(12) United States Patent
Lykowski et al.

(10) Patent No.: US 10,464,701 B2
(45) Date of Patent: Nov. 5, 2019

(54) METHOD AND APPARATUS FOR PERFORMING MULTIPLE TASKS ON A WEB OF MATERIAL

(71) Applicant: Mars, Incorporated, McLean, VA (US)

(72) Inventors: Meghan Lykowski, Lebanon, OH (US); Deborah Sue Slovut, Madeira, OH (US); Joseph Latta, McComb, OH (US); Joseph A. Barlage, Leipsic, OH (US); George Stacy Shumpert, Liberty Township, OH (US)

(73) Assignee: Mars, Incorporated, McLean, VA (US)

( * ) Notice: Subject to any disclaimer, the term of this patent is extended or adjusted under 35 U.S.C. 154(b) by 921 days.

(21) Appl. No.: 14/205,529

(22) Filed: Mar. 12, 2014

(65) Prior Publication Data

US 2014/0274629 A1 Sep. 18, 2014

Related U.S. Application Data

(60) Provisional application No. 61/786,673, filed on Mar. 15, 2013.

(51) Int. Cl.
*B65B 41/16* (2006.01)
*B65B 57/04* (2006.01)
(Continued)

(52) U.S. Cl.
CPC ..... *B65B 41/16* (2013.01); *B65B 9/20* (2013.01); *B65B 57/04* (2013.01); *B65B 61/188* (2013.01);
(Continued)

(58) Field of Classification Search
CPC ..... B65B 41/16; B65B 9/20; B65B 57/04; B65B 61/188; B31B 2219/022;
(Continued)

(56) References Cited

U.S. PATENT DOCUMENTS 3,802,051 A * 4/1974 Andler ..... B65H 26/00 29/707
4,639,263 A * 1/1987 Kulikauskas ..... B07C 5/126 65/158
(Continued)

FOREIGN PATENT DOCUMENTS

CA 2173931 10/2002
DE 19514728 10/1996
(Continued)

OTHER PUBLICATIONS

Newton 400 Intermittent Motion Packaging Machine Brochure, UVA Packaging, Richmond VA, USA, 2 pages, downloaded from the internet on Dec. 11, 2016, http://www.uva-packaging.com/data/uploads/uva%20packaging/Machine%20leaflets/Newton_1_2011.pdf.

*Primary Examiner* — Sameh Tawfik
(74) *Attorney, Agent, or Firm* — Mars, Incorporated

(57) ABSTRACT

A method and apparatus for accurately performing multiple tasks on a web of material are described herein. The method and apparatus include at least a first detector for detecting a detectable feature on the web of material for performing a first operation at a first location on the web of material, and a second detector for detecting a detectable feature on the web of material for performing a second operation at a second location on the web of material. The method and apparatus further include an automated compensating device that cooperates at least indirectly with the detectors. The compensating device reduces any variations in position along the length of the web of material between at least one of said first locations and/or said second locations.

7 Claims, 2 Drawing Sheets

(51) Int. Cl.

| | |
|---|---|
| ***B65B 61/18*** | (2006.01) |
| ***B65B 9/20*** | (2012.01) |
| *B31B 70/10* | (2017.01) |
| *B31B 70/14* | (2017.01) |
| *B31B 70/81* | (2017.01) |
| *B31B 70/00* | (2017.01) |

(52) U.S. Cl.
CPC ..... *B31B 70/006* (2017.08); *B31B 70/10* (2017.08); *B31B 70/14* (2017.08); *B31B 70/81* (2017.08); *B31B 70/8133* (2017.08)

(58) Field of Classification Search
CPC ..... B31B 2219/14; B31B 2219/90; B31B 2219/9022; B31B 2219/95; B31B 70/14; B31B 70/81; B31B 70/8133
USPC ..... 493/17
See application file for complete search history.

(56) References Cited

U.S. PATENT DOCUMENTS 4,655,862 A 4/1987 Christoff et al.
5,000,725 A 3/1991 Bauknecht
5,292,299 A 3/1994 Anderson et al.
5,315,807 A * 5/1994 Restle ..... B26D 5/32 493/9
5,388,387 A * 2/1995 McElvy ..... B65B 9/207 156/502
5,518,559 A 5/1996 Saindon et al.
5,557,907 A * 9/1996 Malin ..... B65B 9/20 53/139.2
5,660,674 A 8/1997 Saindon et al.
5,660,725 A 8/1997 Klass
5,800,325 A * 9/1998 Wilkes ..... B31B 19/00 493/196
5,816,018 A * 10/1998 Bois ..... B65B 9/20 53/133.4
5,861,078 A 1/1999 Huben et al.
5,971,905 A * 10/1999 Fukuda ..... B65B 9/20 493/25
6,004,252 A * 12/1999 Blaser ..... B31B 19/00 493/186
6,017,412 A * 1/2000 Van Erden ..... B31B 70/00 156/290
6,032,437 A * 3/2000 Bois ..... B65B 9/20 493/213
6,131,369 A * 10/2000 Ausnit ..... B65B 9/20 493/213
6,195,967 B1 * 3/2001 Todd ..... B29C 66/474 53/139.2
6,251,209 B1 6/2001 Johnson
6,319,182 B1 * 11/2001 Schneider ..... B31B 19/00 493/10
6,386,851 B1 5/2002 Gustaffson
6,389,780 B1 * 5/2002 Coomber ..... B65B 9/093 53/133.4
6,530,870 B2 * 3/2003 Buchman ..... B65B 9/20 493/114
6,711,875 B2 3/2004 Tax et al.
6,886,310 B1 * 5/2005 Bois ..... B65B 61/188 53/412
6,976,946 B2 * 12/2005 Wied ..... B31B 19/00 493/3
7,022,057 B2 * 4/2006 Colla ..... B31B 19/00 242/554.1
7,175,582 B2 2/2007 Owen
7,266,934 B2 * 9/2007 Leighton ..... B65B 9/06 383/63
7,413,535 B2 * 8/2008 Schneider ..... B65D 33/25 493/394
7,673,437 B2 * 3/2010 Schneider ..... B65D 33/2591 53/139.2
8,145,343 B2 * 3/2012 DeBruler ..... A61F 13/15772 226/10
8,145,344 B2 3/2012 Debruler et al.
8,168,254 B2 * 5/2012 Dovertie ..... A61F 13/15699 118/33
8,578,685 B2 * 11/2013 Fitzgerald, IV ..... B65B 9/08 53/284.7
9,334,074 B2 * 5/2016 Spix ..... B65B 57/02
2002/0155936 A1 10/2002 Krueger et al.

FOREIGN PATENT DOCUMENTS

| | | |
|---|---|---|
| EP | 0562443 | 9/1993 |
| EP | 0873856 | 3/2005 |
| JP | 2007111861 A | 5/2007 |
| JP | 2009161228 A | 7/2009 |
| JP | 2011121220 A | 6/2011 |

* cited by examiner

METHOD AND APPARATUS FOR PERFORMING MULTIPLE TASKS ON A WEB OF MATERIAL

FIELD OF THE INVENTION

A method and apparatus for performing multiple tasks on a web of material are described herein.

BACKGROUND

Many types of articles are currently manufactured from one or more webs of materials. Methods of making articles from one or more webs of material include, but are not limited to: processes for making empty bags; processes for making and filling bags; and, processes for making disposable absorbent articles. During manufacture, the web(s) of material may be moved through the manufacturing process, and may have various tasks performed on the same to produce the final product.

Methods of making disposable absorbent articles are described in U.S. Pat. Nos. 8,145,343 B2 and 8,145,344 B2, both to DeBruler, et al; and U.S. Pat. No. 8,168,254 B2, Dovertie, et al. Methods and apparatuses for making bags and attaching features to the same are described in the patent literature, including in the following patent publications: U.S. Pat. No. 5,000,725, Bauknecht; U.S. Pat. No. 5,292,299, Anderson, et al.; U.S. Pat. Nos. 5,518,559 and 5,660,674 to Saindon, et al.; U.S. Pat. No. 5,861,078, Huben, et al.; Canadian Patent Application 2,173,931; U.S. Pat. No. 6,251,209 B1; and U.S. Pat. No. 7,175,582 B2, Owen. Machines for making bags and attaching features to the same are also commercially available. One such machine is the NEWTON 400® intermittent motion packaging machine sold by UVA Packaging, Richmond Va., U.S.A.

The search for improved methods and apparatuses for accurately performing multiple tasks on moving webs of material during manufacturing processes has, however, continued. For example, the film used to make pet food bags is typically a composite of two laminates, with a first laminate comprising the printing, and a second laminate providing the main body and strength to the bag. The printed laminate comprises repeating graphics, associated with each bag to be made, and each of them comprises at least one registration mark to signal to the equipment when to perform certain tasks, like placing a zipper or other features, forming a seal and making a cut between bags. If only one registration mark is used per bag, then the distance between registration marks is a measure of the bag length for the bags next to the registration marks. As this film is presented to the bag making machine, any variation in the distance between registration marks can cause problems in accurately performing those tasks. The variation in the distance between registration marks or otherwise variation in the bag length can be introduced in a number of ways including, but not limited to: (1) variations in the printing of the films used to make the bags; (2) variations in winding of the films; (3) stretching of the films during manufacture; (4) variations in length due to splicing of film rolls at the film manufacturer; (5) variations in length due to splicing of the film rolls at the bag manufacturing plant; (6) variations that may be inherent in the machine, such as due to wear; and (7) creep in the wound roll due to storage or winding conditions.

Therefore, there is a need for an improved method and apparatus for accurately performing multiple tasks on a moving web of material. For example, it is desirable to improve the accuracy of placing features such as zippers on bags, and making cuts that are well aligned to graphics on the bag material. Such improvements can result in significant savings in avoiding creating defective bags of products due to improper seals or graphics issues.

SUMMARY

A method and apparatus for performing multiple tasks on a web of material are described herein. The method and apparatus comprise at least a first detector for detecting a detectable feature on the web of material for performing a first task at a first location on the web of material. The method and apparatus also comprise a second detector for detecting a detectable feature on the web of material for performing a second operation at a second location on the web of material. The web of material will typically have a plurality of spaced apart detectable features, and a plurality of spaced apart first locations and second locations. The method and apparatus further comprise a compensating device that cooperates at least indirectly with the detectors. The compensating device may be automated. The compensating device reduces any variations in position along the length of the web of material between at least one of the first locations and/or the second locations. The method and apparatus may be used in the manufacture of any types of articles that are made from at least one web of material. The apparatus may also be provided in the form of a detection and compensating system that can be added to equipment for manufacturing articles.

DETAILED DESCRIPTION

This application claims the benefit of U.S. Provisional Application Ser. No. 61/786,673 filed Mar. 15, 2013, the entirety of which is incorporated by reference herein.

A method and apparatus for performing multiple tasks on a web of material are described herein. The method and apparatus may be used in the manufacture of any types of articles that are made from at least one web of material. Since it is not possible to show every possible use of such a method and apparatus, one example of the method and apparatus is shown. The method and apparatus are shown in conjunction with a bag making machine that forms bags from a web of material. It is understood, however, that the method and apparatus can be used in conjunction with other processes including, but not limited to: processes for making empty bags; processes for making and filling bags; and, processes for making disposable absorbent articles.

Figure 1:
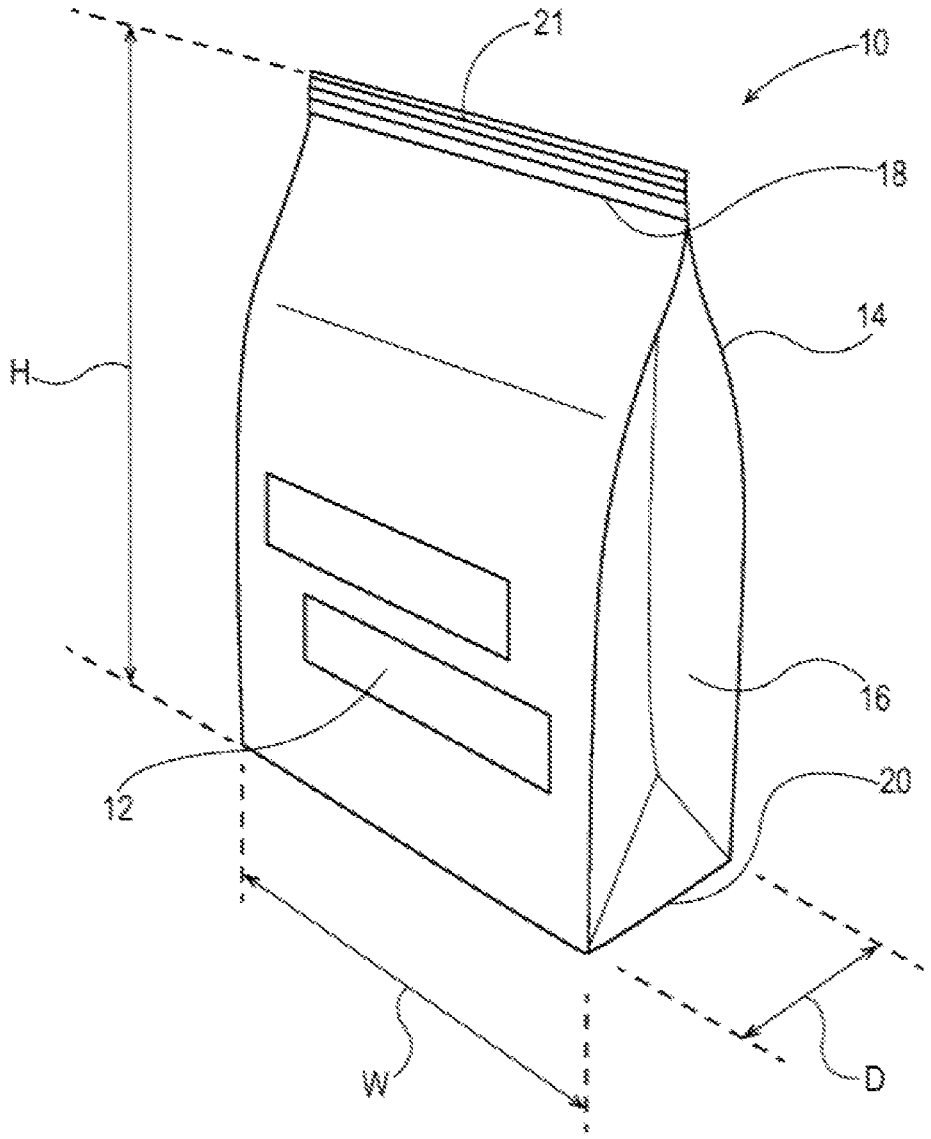
FIG. 1 is a perspective view of one embodiment of a bag.

FIG. 1 shows one non-limiting example of a prior art bag 10 that that can be made by the method and apparatus. The prior art bag is an example of a "block bottom" bag. The bag 10 may be in any suitable configuration including, but not limited to the block bottom bag shown, pillow, gusseted, flat bottom, offset seal, four corner seal, Doy style, block bag, bags with carry handles, and many more possibilities. The bag can optionally be provided with a variety of different re-closure features including, but not limited to: tape; VELCRO® fastener material; a "press to close" zipper; and a slider zipper.

As shown in FIG. 1, the bag 10 has a front 12, a back 14, two sides 16, a top 18, and a bottom 20. The bag 10 further has an optional re-closable seal feature, such as a zipper type seal 21 on the top. In the particular embodiment shown, the bag 10 has a permanent longitudinal back seal (not shown) that holds the bag together and extends between the top and bottom ends of the bag body. In other embodiments, the bag 10 can be constructed in any other suitable manner.

The bag 10 has a height H, a width W, and a depth D. The bag 10 may have any suitable dimensions, and may be used for any suitable purpose. Although the bag 10 shown in FIG. 1 is a pet food bag, the method described herein can also be used to make snack food bags, trash bags, sandwich bags, etc.

The bag 10 can be made of any suitable materials. Suitable materials include films and laminates. The bag is usually manufactured from a web of bag material. The web of bag material will typically comprise an elongate web of film having graphic material repetitively printed thereon that corresponds to the desired size of the bags. In one non-limiting embodiment, the web of bag material comprises a composite of two laminates joined together, with a first laminate having printing thereon, and a second laminate providing the main body and strength to the bag.

The web of bag material 22 may also have at least one detectable feature thereon to signal to the bag-making equipment when the equipment should perform certain tasks. The tasks can include, but are not limited to: printing the entire web, or portions thereof; placing a sticker, a zipper, a valve, or other elements or features on the web; forming a seal; and/or making a perforation and/or a cut between bags. The web can be printed, or a sticker can be added to the web for any suitable purpose including, but not limited to adding a code date or customization text or graphics (such as ingredient statements; guaranteed analysis; sale discounts, etc.).

The detectable feature can comprise anything that is present on the web of bag material 22 that is capable of signaling to the bag-making equipment when the equipment should perform certain tasks. Detectable features include, but are not limited to: elements attached to the web, such as piece of material attached to the web; holes in the web; magnetic elements on the web; or indicia on the web. Suitable indicia include, but are not limited to: a distinguishing feature in a printed pattern on the web of bag material 22, or a specific, mark for such purpose. In certain embodiments, the indicia that provide the signal to the bag making equipment comprise registration marks (or "eye marks") that are well known, and typically printed in regularly spaced locations on the web. Although some portions of this description may refer to indicia or eye marks, it should be understood that any suitable detectable feature may be used.

The web of material can have indicia pre-printed thereon (prior to unwinding the web in the process); or, the indicia (or other features) could be printed on the web during the process described herein. The indicia may be located in an eye track. An eye track is a zone of the web that may (or may not) have the same width as the indicia. The eye track may, or may not run the full length of the web 22. The eye track may be adjacent one of the side edges of the web of material 22. The eye track may be devoid of graphics or otherwise comprise graphics that promote sufficient contrast between the background color and the indicia color for a photocell sensor to unmistakably detect the indicia. The web of material 22 may have any suitable number of detectable features. For instance, the web of material 22 may have: (1) a single detectable feature for each article or bag impression ("bag impressions" are the portion of the web of bag material from which a single bag is made); (2) more than one detectable feature for each article; or (3) one detectable feature to serve several articles.

In one non-limiting embodiment, each of the bag impressions comprises at least one detectable feature. If one detectable feature is used per bag impression, then the distance between detectable features is a measure of the bag length for the bags next to the detectable feature. In this embodiment, the web of material 22 has a first indicia 26 such as a black mark in an eye track along the left side of the web of material, and a second indicia 28 such as a mark in an eye track along the right side of the web of material 22 for each bag impression. Ideally, the detectable features are placed in a location so that they are not conspicuous on the finished bags. In the embodiment of the method and apparatus shown in FIG. 2, the first indicia 26 that is used for zipper placement control is located on the inside of the fin seal which would end up out of sight in the finished bag. The second indicia 28 for cut position control is located on the outside of the fin seal and it is read after the bag is formed, ending up in a discrete location at the bottom of the bag.

Figure 2:
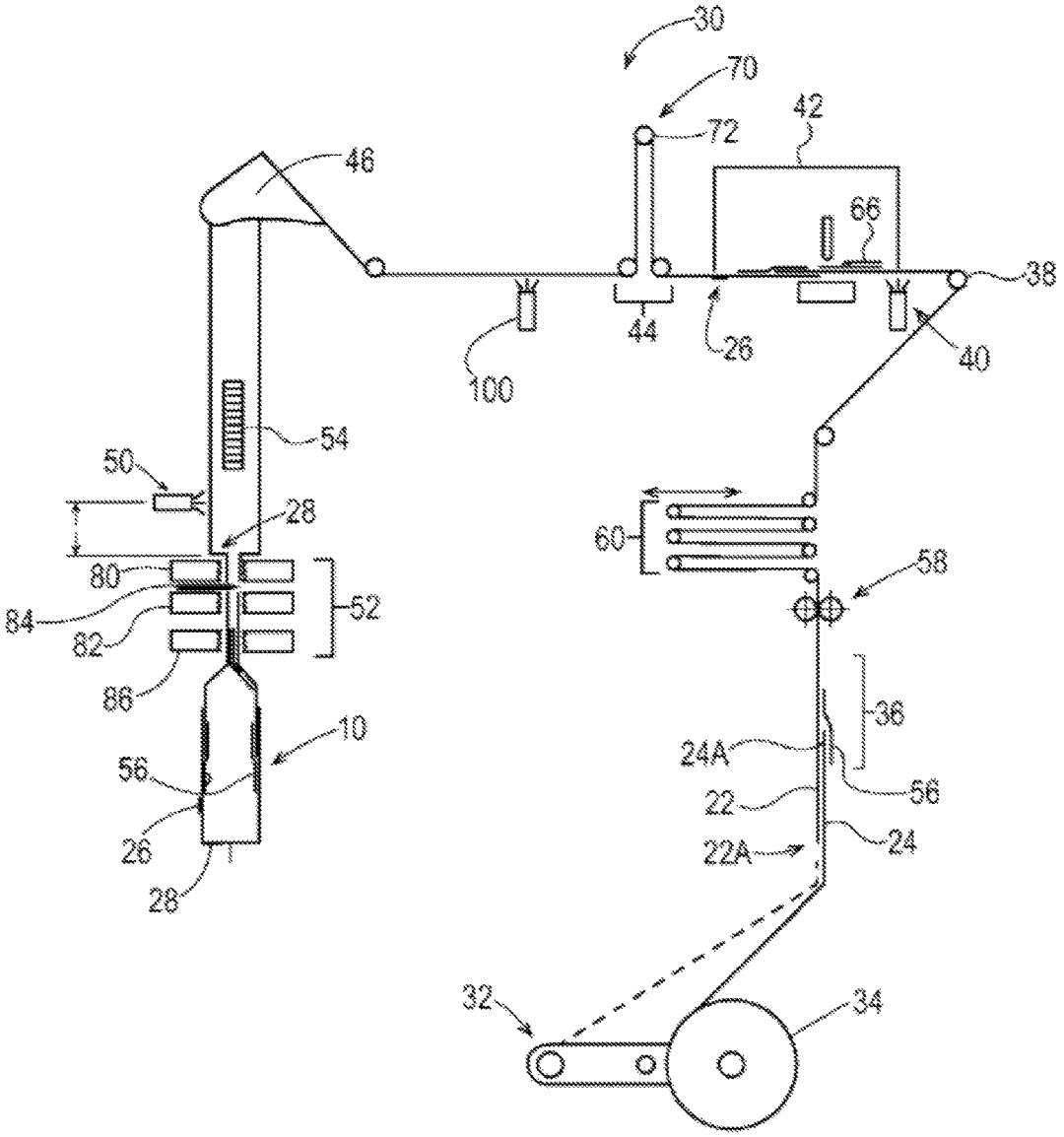
FIG. 2 is a schematic diagram of one embodiment of a method and apparatus for forming bags (that is not to scale).

FIG. 2 is a schematic diagram of one embodiment of a method (or process) and apparatus for forming bags. The method and the apparatus 30 can be in any suitable form, including continuous or intermittent motion (or partially continuous and partially intermittent) methods and apparatuses. One non-limiting example of an intermittent motion apparatus is the NEWTON 400® intermittent motion packaging machine sold by UVA Packaging, Richmond Va., U.S.A.

The apparatus 30 shown in FIG. 2 comprises a first roll 32 for supplying a first web of material 22. The apparatus 30 may further comprise an optional second roll of material (or "splicer unwind roll") 34 for supplying a second web of material 24; and an optional splicing station 36. The apparatus 30 also comprises a first detector 40 for detecting a detectable feature on the web of material. The first detector 40 assists the apparatus 30 in performing a first operation (or task) at a first location on the web of material 22. The first operation on the web of material 22 is performed at a first station 42. In one non-limiting example, the first station is a zipper positioning station. The apparatus 30 further comprises a compensating station 44. The apparatus 30 comprises a second detector 50 for detecting a detectable feature on the web for performing a second operation (or task) at a second location on the web of material 22; and a second station 52 for performing a second operation on the web of material 22. In one non-limiting example, the second station is a cutting station. In the example shown, the apparatus 30 comprises a forming station 46 for forming the web into the configuration of a bag. A forming station may, however, not be included in other types of processes. The apparatus 30 may further comprise an optional brake 38, and other optional components.

The web of material 22 can be moved through the process by any suitable mechanism. Suitable mechanisms include, but are not limited to: any suitable type of driven element including but not limited to rollers (e.g., actively moving rollers, such as rollers in festoon arrangements, and nip rolls); vacuum conveyors; and belts. In the embodiment shown in FIG. 2, the web of material 22 is pulled through the process by draw down belts 54. The draw down belts 54 or other mechanism may not only be capable of continuously moving the web of material 22, but may also be capable of advancing the web of material 22 incrementally either a greater or lesser amount depending on what is needed in order to bring the web of material 22 into the desired registration for performing an operation at one or more of the stations. The draw down belts 54 may, thus, be considered to be an "indexing" system.

FIG. 2 shows the process at a stage in which the first roll of material 32 has been depleted and the second web of material 24 is being fed into the process. The trailing edge of the first web of material 22 is designated 22A. The leading edge of the second web of material 24 is designated 24A. The web of material 24 from the second roll is fed into the process so that the second web of material 24 overlaps the end portion 22A of the first web of material 22 so that the two webs can be spliced together at the splicing station 36. It should be understood that the method can be carried out using only a single roll of material, and thus a second roll of material 34 and the splicing station 36, while usually present, are optional.

At the splicing station 36, the first and second webs of material 22 and 24 are spliced together with a tape 56. The taped webs are then passed between a pair of driven pinch rolls 58 to secure the tape 56 to the webs. After the web of material 22 leaves the splicing station 36, it passes through an optional tensioner 60. In the embodiment shown, the tensioner 60 comprises a dancer. The dancer maintains tension on the unwind roll 34.

The bag 10 can optionally be code dated (to provide an expiration date, or the like) at any suitable stage in the process. In the embodiment shown in FIG. 2, the bag material may be code dated as it passes between the dancer 60 and the brake 38. The brake 38 can be any suitable type of device that is capable of maintaining tension on the web of material between the draw down belts 54 and the brake 38, and, if desired, stopping the movement of the web 22. Suitable devices for stopping the movement of the web 22 include, but are not limited to mechanical devices (such as clamping systems), and vacuum brakes. In this embodiment, the brake 38 comprises a vacuum brake.

The web of material 22 then passes by a detector, first detector 40, which comprises a component of a detection system. The first detector 40 is provided for detecting a detectable feature on the web of material 22 for performing a first operation at a first location on the web of material. The first operation can be any operation in the manufacturing (e.g., bag making) process. In the embodiment shown, the first operation is a step of joining a zipper element to the web of material 22. As shown in FIG. 2, the first detector 40 may be located prior to (or "upstream" of) the first station 42, the zipper positioning station, and in relatively close proximity to the same. The first detector 40 may be located above the path of the web of material 22. When the first detector 40 is described as being in relatively close proximity to the first station 42, the first detector 40 may, for example, be a distance that is less than or equal to 2, 1, or ½ of the length of the article to be formed (e.g., bag impressions) prior to the first station 42.

The first detector 40 can be any suitable type of detection mechanism. Suitable types of detection mechanisms include, but are not limited to: a camera, a vision system, a proximity switch, a magnetic detector, or other suitable detection mechanism. The type of detection mechanism, of course, must be of a type that can detect the particular type of detectable features on the web of material 22. In the embodiment shown, the first detector 40 comprises a photo eye (or "photocell"), first photo eye. The first photo eye may detect indicia 26, such as a first eye mark.

The first detector 40 is in communication with a controller (not shown). The controller typically includes a central processing unit (CPU) (or any other digital logic device) and receives as input the output from the detector 40. The controller could alternatively include analog logic circuits or any other device that provides the proper outputs in response to the inputs. The controller can also receive input from at least one optional encoder (not shown). Encoders may or may not be used. In the embodiment described herein, however, at least one encoder is used. Although the indicia 26 is shown in FIG. 2 as having passed the first detector 40, this is due to the movement of the web of material 22 past the first detector 40, and it should be understood that the web of material 22 will have additional indicia thereon upstream of the first detector 40. The first detector 40 reads the position of the indicia 26 relative to the position of the first station 42 generated by the first detector 40, based on the input from an encoder. The encoder may be used to measure the distance the web 22 has traveled in the machine direction. This measurement can be done directly by having the encoder ride directly on the web 22, or indirectly by monitoring the rotation of a drive roll or some other component that is involved in the web movement. In one embodiment, the encoder may be located in close proximity to the location for the cut/seal. For example, the encoder may ride on the surface of the formed bag near the drawdown belts 54 to ensure that adequate compensation is made for any slip that may occur between the web 22 and the drawdown belts 54. In this embodiment, or in other embodiments, one or more encoders may be located upstream of: the compensating device 70, the first station 42, and/or the first detector 40. In the fully automated mode, the controller can determine the nominal bag length (spacing between detectable features), as well as variations from the nominal bag length.

The web of material 22 then proceeds to the first station, which in this case is a zipper positioning station 42. At the zipper positioning station 42, a zipper element 66 is cut from a continuous web of zipper material, and is joined to a first location on the web of material 22. The zipper element 66 may be either temporarily or permanently joined to the web of material 22. When it is said that the zipper element 66 may be temporarily joined to the web of material 22, it is meant that the zipper element 66 may initially be "tacked" in place onto the web of material 22 at the first station 42, and then more completely joined to the web of material 22 at an operation downstream of the first station 42. The zipper element 66 comprises first and second interlocking fasteners, each of which comprises a flange portion for joining the same to the web of material 22. The zipper element 66 may be transversely joined to the surface of the web of material 22 that will form the interior surface of the formed bag. The zipper element 66 may be joined to the web of material 22 at a landing zone on at least one of the flanges of the zipper element 66. The zipper element 66 can be joined to the web of material 22 by any suitable sealing mechanism. In one embodiment, the zipper element 66 is initially temporarily joined to the web of material 22 by adhesive heated sealing element at the first station 42, and is then more completely sealed to the web of material 22 using a sealing bar at the second station.

The web of material 22 then proceeds to the compensating station 44. The compensating station 44 comprises a compensating device 70 for reducing any variations in position along the length of the web of material between at least one of said first locations and/or said second locations. If necessary, the compensating device 70 moves at least a portion of the web of material to adjust the relative position of at least one of the first locations and the second locations to reduce variations therebetween. This is done in order to bring the desired portion of the web of material 22 into position for performing the desired operations at the proper locations on the web of material 22. The compensating device may, for example, compensate for a mis-phasing or registration errors in the web of material at the first station 42 for proper zipper placement, when the web of material is properly positioned at the second station, cutting station 52. The detection system may permit the apparatus 30 to stop only once per bag (for the steps of forming the cut and applying the zipper), instead of stopping once to form the cut, then advancing the web of material slightly and stopping the web a second time (per bag) to apply the zipper. A double stop per bag would substantially slow down the line speed.

The compensating device 70 can comprise any suitable type of device that is capable of providing independent control of the web of material 22 into a first and second station, and advancing or retarding a portion of the web of material 22. Suitable devices include, but are not limited to: a web handling driven roll followed by a dancer, such as a pneumatically-loaded dancer; and, an auto compensation take-up roller. In the embodiment shown, the compensating device 70 comprises an auto compensation take-up roller 72 (for example, a servo controlled take-up roller) that can be raised or lowered to advance or retard the web of material 22. The compensating device 70 may, thus, change the path length of the web 22 between the first and second stations. In the embodiment shown, the second detector 50 detects the detectable feature (for the second station 52) and the first detector 40 detects a detectable feature (for the first station 42). If any adjustment is necessary, the compensating device 70 makes a web path length adjustment during a brief window of time before the web 22 comes to a stop at the second station 52. The compensating device 70 is not required to stretch the web of material 22, or to increase the speed at which the web of material 22 is moved. Of course, in various different embodiments, the web of material 22 could be stretched or moved at an increased or decreased speed by the compensating device 70.

The compensating device 70 may be an automatic compensating device (when in communication with the detectors and the controller). The compensating device 70 may have the ability to make a compensating adjustment (if necessary) for any (or every) article being made. The compensating device 70, thus, may automatically compensate for errors in sizing of bags by adjusting the relative position of the web of material 22 at the first station to properly register a first location of the web of material 22 to the task to be performed at the first station, when a second location of the web of material 22 has been properly registered for the task to be performed at the second station. This allows multiple tasks to be performed at multiple locations on the web of material 22 without having to stop the movement of the web of material more than once per bag. In other embodiments, the movement of the web of material 22 can be stopped at the compensating station 70, if desired. In the embodiment shown, the web of material 22 is stopped once to correspond with the seal/cut task using the second indicia and second photocell, while the web position is adjusted. The web position is either advanced or retarded by changing the web path length at the compensating station 70 to properly locate the first location on the web of material at the first station for application of the zipper to the web of material. This can happen independently of the bag material being stopped in the second station because of the buffer built into the auto compensate take-up roller 72. The advancement or retardation of the bag material is a function of when the first and second photocells 40 and 50 detect their corresponding first and second indicia 26 and 28 in a given cycle. A calculation is then performed by the PLC that accounts for the adjustment necessary.

The web of material 22 then proceeds to the forming station 46 where the flat web of material 22 is formed into the shape of a bag. The web of material 22 can be formed into the shape of a bag by any suitable commercially available bag former. In one non-limiting embodiment, the commercially available bag former is a vertical, form, fill, sealing former. Such a former comprises part of the NEWTON 400® intermittent motion packaging machine. In this case, the former wraps the web of material 22 around on itself to form a longitudinal overlapping portion of the web of material, and forms the longitudinal back seal on the overlapping portion.

The web of material 22 then passes by the second detector 50, which also comprises a component of the detection system. The second detector 50 is provided for detecting a detectable feature on the web of material 22 for performing a second operation at a second location on the web of material. It should be understood that the first location and the second location on the web of material 22 for a particular individual article may be: at the same location on the web; at entirely different locations on the web of material; or, on at least partially different locations on the web. The embodiment shown in FIG. 2 is an example of the latter. The second operation is cutting and sealing the web of material 22, which includes permanently joining the zipper element 66 to the web, as well as cutting and sealing adjacent portions of the web. As a result, the second location can be considered to span an area of the web that includes the first location where the zipper was initially temporarily joined to the web. As shown in FIG. 2, the second detector 50 may be located prior to the cutting and sealing station 52, and in relatively close proximity to the same. When the second detector 50 is described as being in relatively close proximity to the second station 52, the second detector 50 may, for example, be a distance that is less than or equal to 2, 1, or ½ of the length of the article to be formed (e.g., bag impressions) prior to the second station 52.

The second detector 50 can be any suitable type of detection mechanism. The second detector 50 can comprise any of the types of detection mechanisms described as being suitable for use as the first detector 40. The second detector 50 can comprise the same type of detection mechanism as the first detector 40, or a different type of detection mechanism. The second detector 50 can detect the same detectable features as the first detector, such as first detectable features (e.g., the first indicia 26). In other embodiments, however, the second detector can detect different detectable features than are detected by the first detector 40. In the embodiment shown, the second detector 50 comprises a photo eye, second photo eye, and the second photo eye detects the second indicia 28. The second detector 50 may operate in a similar manner to the first detector 40, or a different manner.

The second detector 50 can detect detectable features that are in a different category from those detected by the first detector 40. For example, such features may differ in type and/or relative position on the web of material 22. By different "type", the detectable features may differ in any suitable manner that may be distinguished by the detectors. Such different types of detectable features include, but are not limited to: differences in mechanism of detection (e.g., optical versus magnetic); differences in color; differences in shape; differences in opacity (or other differences in detectable level). By different "relative position", it is meant that the second detectable features may repeat on a different portion of the web of material 22 than the first detectable features. (Thus, each spaced apart first detectable feature is not considered to constitute a different category of detectable features.)

It should be understood that while the first and second detectors 40 and 50 may be directly detecting the detectable features, they are at least indirectly detecting the first and second locations on the web of material 22 (after the CPU calculates these locations). Therefore, the first and second detectors 40 and 50 may also be considered to be detecting the first and second locations on the web of material 22.

The web of material 22 then passes to the second station 52. In this embodiment, the second station is a cutting and sealing station 52. In the embodiment shown, the cutting and sealing station 52 comprises: a first sealing mechanism 80; a second sealing mechanism 82; a cutting mechanism 84; and a third sealing mechanism 86. At the cutting and sealing station 52, a bottom seal is created for an upcoming bag, while simultaneously, a top seal and zipper seal is created for the preceding (just filled) bag, and a cut is made to separate both bags. More specifically, the first sealing mechanism 80 forms the bottom seal; the second sealing mechanism 82 forms the top seal; and the third sealing mechanism 86 forms the zipper seal. The first, second, and third sealing mechanisms may be separate sealing mechanisms. Alternatively, two or more of the sealing mechanisms could be in the form of a combined sealing mechanism. In addition, any of the sealing mechanisms could be combined with the cutting mechanism to form a cutting/sealing mechanism. After the bottom seal is formed for the upcoming bag, the bag is filled with the desired product (for example, dry dog food). For each bag that is made, there is a stop in the flow of the bag material when all the cutting and sealing takes place that is driven by the equipment detecting the pertinent detectable feature. The process is repeated for each bag impression along the length of the web of material.

In the embodiment in FIG. 2, the example of the bag 10 shown has a splice on the interior of the bag. This is illustrated by the presence of the splice tapes 56. It should be understood that this is for purposes of illustration, and most bags will not have a splice inside.

The detection system described herein may represent an improvement over prior systems that have been used to perform multiple tasks on a moving web. For example, some prior systems have no detection systems. Other prior systems relied upon a single detector to detect both where to attach an element, such as a zipper element, to the web of material, and to detect where to cut and seal the formed web of bag material. FIG. 2 shows one example of where such a prior detector 100 may have been located in such a system. Such prior systems also typically did not comprise an automated compensating station capable of making an adjustment, if necessary, for any bag being made (without any input from an operator). In such a prior system, the position for placement of the zipper in the first station 42 and the seal/cut position in the second station 52 were controlled by a single detector 100 that was about half way between the two stations. The prior detector 100, such as a photocell that detected the indicia could be a substantial distance from the zipper placement (e.g., about 3 to 4 bag lengths) and from the seal/cut position (e.g., about 4 to 5 bag lengths). If the bag length was always consistent and on target, a single photocell would be sufficient to accurately locate the zipper and the seal/cut positions.

However, because of the previously explained variation in bag length introduced by various means, any discrepancies between the target bag length and the bag lengths of the "bags" (yet to be made) located between the photocell 100 and the first and second stations 42 and 52, respectively, would be magnified by as many times as there are bags between the photocell and the pertinent station. So, for example, if the target bag length is 900 mm, and due to stretching, the web of material has actual bag lengths of 902 mm, over, for example, 5 bag lengths between the photocell and the seal/cut position, a 5×(902−900 mm)=10 mm variance would be accumulated. This could lead to a substantial difference between a properly sealed and cut bag, and may form a bag that would need to be scrapped. In some cases, this could cause the third sealing mechanism 86 to seal the bag material rather than the flanges of the press-to-close zipper. Under these conditions, the press-to-close zipper would not be attached to the bag material properly and could not be used to re-close the bag.

In the embodiment of the method described herein, the first photocell 40 is located near the first station 42 and controls the zipper 66 placement on the web of material 22. The second photocell 50 is located near the second station 52 and controls the bag material stopping position for seal/cut within its impression. Having the two indicia and placing the photocell locations near their respective tasks provides the accuracy needed to place the zipper and cut/seal the bag material 22. In the embodiment described herein, the system allows these tasks to be performed with an accuracy of 2 mm along the web of material. This configuration accommodates bag length variation (variation in the distance between indicia) that exists due to printing and winding process variations. The use of two separate photocells to detect two separate indicia and independently control the bag material movement at the first station when it is stopped at the second station provides greater accuracy in the placement of zipper and seal/cut location, which in turn provides for accurate vertical graphic alignment and a zipper that is consistently functional. This may reduce the level of scrap or defective bags produced. Additionally, when rolls are spliced together, the machine can immediately accommodate a change in indicia to indicia distance between the rolls so that the operator does not have to make any manual adjustments to minimize scrap.

Numerous variations of the process and apparatus described herein are possible. For example, the process and apparatus could be applied to methods for forming bags out of more than one web (for example, such as where the front of the bag is formed from a portion of one web and the back of the bag is formed from a portion of another web). In alternative embodiments, the elements shown in FIG. 2 may be configured in other ways, including by removing one or more of the elements shown therein. In other cases, the apparatus may have other elements added thereto depending on the type of product being produced. Further, although the process and apparatus are described in terms of applying a zipper and cutting and sealing the bags, the process and apparatus can also be used to carry out any combination of operations, including, but not limited to the following: perforating, cutting, punching, zipper (or other feature) attaching or adding, folding, or any other operation to be performed in order to form the desired article from at least one web of material.

Alternative arrangements of the detectors 40 and 50 and the detectable features that they detect are also possible. For example, in alternative embodiments, the detectors and/or the controller can ignore printed matter on the web between specific selected features in the printed matter or between marks printed for the purpose of registration to the printed pattern. In alternative embodiments, there can be additional detectors (that is, more than two detectors), and additional detectable features that they detect. Another option is to use the two detectable features and the two detectors to stop the web of material twice in each product cycle, once to perform the first operation, and once to perform the second operation. Although, this latter embodiment is not ideal since it would slow down the line.

Alternatively, one could choose to rely on a single detectable feature per article. For example one could rely on a single eye track and run the zipper and seal/cut tasks from that single eye track. On a given cycle, the two stations 40 and 50 would be detecting different indicia from which the calculations can be drawn to determine the appropriate adjustment for the compensating station 70. Eventually, the indicia detected by the first station 40 would be detected by the photocell in the second station in a different cycle of the bag making process. Such indicia may need to be visible from the outside of the bag to be detectable by the photocell in the second station. This is only if there is a desire to have the indicia as close as possible to the seal/cut point. Otherwise, the indicia could be located also to end up in the inside fin seal as well.

In still other embodiments, any suitable commercially available machine could be retrofitted with any combination of the detection system (and an associated control system, if needed) and the compensating station. Such a retrofitting package may comprise a separate invention in its own right.

In other embodiments, the process and apparatus may comprise more than one compensating station. Such additional compensating stations may be used for performing any suitable operation on the web of material 22. For example, in the embodiment shown, an additional compensating device may be used to ensure that the code dating is applied to desired place on the web of material 22.

In other embodiments, the detection system can be applied to any other types of processes that involve performing more than one operation at a different location on a moving web of material. This is particularly the case where registration of the output of two or more operations is required. Such other types of processes may include, but are not limited to: bag making processes other than VFFS processes (including, but not limited to horizontal, form, fill, sealing (HFFS) processes); package making processes for types of packages other than bags; and processes for making disposable absorbent articles including, but not limited to: bandages, wraps, incontinence devices, diapers, sanitary napkins, pantiliners, tampons, and hemorrhoid treatment pads, as well as other consumer products such as floor cleaning sheets, body wipes, and laundry sheets.

The term "joined to" encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined to" encompasses configurations in which an element is secured to another element at selected locations, as well as configurations in which an element is completely secured to another element across the entire surface of one of the elements.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for forming bags from a web of material, comprising:

a first detector;

an adhesive heated sealing element for a temporarily transverse join of a re-closure feature to the web of material;

a compensating device positioned downstream of the first detector and the adhesive heated sealing element for making a compensating adjustment that changes a path length of the web of material;

a sealing bar positioned downstream of the compensating device for a permanently sealing and cutting the web re-closure feature of material to form individual bags; and a second detector positioned downstream of the compensating device and a distance less than or equal to two lengths of the individual bags being formed from the sealing bar.

2. The apparatus of claim 1, wherein the re-closure feature is a zipper.

3. The apparatus of claim 1, further comprising a bag former.

4. The apparatus of claim 3, wherein the second detector is downstream of the bag former.

5. The apparatus of claim 1, wherein the compensating device includes a web handling driven roll and a dancer.

6. The apparatus of claim 1, wherein the compensating device includes an auto compensation take-up roller.

7. A method for forming a bag from a web of material, comprising:

providing a web of material having at least one detectable feature to an apparatus comprising:

a first detector;

an adhesive heated sealing element;

a compensating device positioned downstream of the first detector and the adhesive heated sealing element;

a sealing bar positioned downstream of the compensating device; and a second detector positioned downstream of the compensating device and a distance less than or equal to two lengths of the individual bags being formed from the sealing bar;

temporarily transversely joining a re-closure feature to the web of material with the adhesive heated sealing element;

detecting a variation along a length of the web of material with the second detector;

adjusting a path length of the web of material with the compensating device to account for the variation along the length of the web of material; and permanently sealing and cutting the web and the re-closure feature of material with the sealing bar to form the bag.

* * * * *